US007585253B2

(12) United States Patent
Richards

(10) Patent No.: US 7,585,253 B2
(45) Date of Patent: Sep. 8, 2009

(54) POLE VAULT TRAINING DEVICE

(76) Inventor: Kirk Richards, P.O. Box 182, Goodrich, MI (US) 48438

( * ) Notice: Subject to any disclaimer, the term of this patent is extended or adjusted under 35 U.S.C. 154(b) by 84 days.

(21) Appl. No.: 11/624,060

(22) Filed: Jan. 17, 2007

(65) Prior Publication Data

US 2008/0171637 A1 Jul. 17, 2008

(51) Int. Cl.
*A63B 5/06* (2006.01)
*A63B 5/00* (2006.01)

(52) U.S. Cl. ..... 482/18; 482/15

(58) Field of Classification Search ..... 482/112, 482/18, 14–15, 33
See application file for complete search history.

(56) References Cited

U.S. PATENT DOCUMENTS

| | | | | | |
|---|---|---|---|---|---|
| 1,907,451 | A | * | 5/1933 | Sibley | 482/33 |
| 2,110,251 | A | | 3/1938 | Austin | |
| 3,012,778 | A | * | 12/1961 | Whittaker et al. | 482/18 |
| 3,587,319 | A | * | 6/1971 | Andrews | 482/112 |
| 3,940,137 | A | * | 2/1976 | Taylor | 273/317.1 |
| 3,969,557 | A | * | 7/1976 | Jenks | 428/34.5 |
| 4,017,070 | A | | 4/1977 | Hilton | |
| 4,245,838 | A | * | 1/1981 | Gordon | 482/17 |
| 4,778,174 | A | | 10/1988 | Tolsma | |
| 4,979,736 | A | | 12/1990 | Maynard et al. | |
| 5,372,564 | A | * | 12/1994 | Spirito | 482/112 |
| 5,755,649 | A | * | 5/1998 | Bimby | 482/126 |
| 6,162,148 | A | | 12/2000 | Lockwood et al. | |
| 6,932,744 | B1 | | 8/2005 | Ford et al. | |
| 2004/0053747 | A1 | | 3/2004 | Bollinger | |
| 2004/0067820 | A1 | | 4/2004 | Noble et al. | |
| 2004/0116259 | A1 | | 6/2004 | Rosiles | |
| 2004/0198556 | A1 | | 10/2004 | Rastegar | |
| 2005/0239603 | A1 | | 10/2005 | Canali | |

FOREIGN PATENT DOCUMENTS

| | | |
|---|---|---|
| CH | 276174 | 6/1951 |
| DE | 2319877 | 11/1973 |
| DE | 2639882 | 3/1978 |
| DE | 3617156 | 11/1987 |
| DE | 3931319 | 3/1991 |
| EP | 0205955 | 12/1986 |
| GB | 923242 | 4/1963 |
| GB | 923243 | 4/1963 |
| JP | 10179792 | 7/1998 |
| JP | 11226147 | 8/1999 |
| SU | 650640 | 3/1979 |

* cited by examiner

*Primary Examiner*—Fenn C Mathew
(74) *Attorney, Agent, or Firm*—Gifford, Krass, Sprinkle, Anderson & Citkowski, P.C.

(57) ABSTRACT

A pole vault training apparatus may include a housing, a pole receiver pivotably positioned on the housing, a lift assembly positioned in the housing and a reinforced vaulting pole. In operation, the vaulting pole may be placed in the pole receiver. The lift assembly then drives the pole receiver (with the pole) such that the pole (and a user that may be holding the pole) is raised or lowered through a predetermined arc of travel. In use, the apparatus permits a user to perform a vault maneuver starting from standing position near the apparatus.

20 Claims, 4 Drawing Sheets

10
12
14
18
20
22
24
28
30
36
48
54
58
60
62
64
74
90
94
100
102
106
108
110
112
113
114
116

POLE VAULT TRAINING DEVICE

CROSS-REFERENCE TO RELATED APPLICATIONS

Not applicable.

FIELD OF THE INVENTION

Disclosed herein is an embodiment for a pole vault training apparatus that may include a driven, pivoting receptacle into which may be placed a modified vaulting pole. The pole vault training apparatus may operate to lift and propel a user holding the pole from a standing position, upwardly to any point along an arc of travel including to a near vertical position. Accordingly, the pole vault training apparatus may allow a user to undertake multiple practice "vaults" without the need for a running approach.

BACKGROUND OF THE INVENTION

The pole vault is a difficult and dangerous sport, two factors that inhibit the sport's growth. While danger can be mitigated through practice, the very nature of the sport limits the amount of practice that can be accomplished at any given time. The reason is fatigue. Even an unsuccessful vault attempt may require that the athlete take a fast running approach toward the "pit" of between 70 and 120 feet while carrying a pole that measures between 10 feet 6 inches and 17 feet 6 inches. Under such conditions, fatigue sets in quickly. As a result, a typical pole vaulter may only manage six to eight full approach practice jumps per day.

Past attempts to develop devices that permit an athlete to experience an actual jump in a repeatable and safe manner have met with only limited success. As such, there is a need for a further advancement of the art.

SUMMARY OF THE INVENTION

A pole vault training apparatus may include a housing or body, a pole receiver that may be pivotably positioned on the housing, a lift assembly that may be positioned in the housing and secured to the pole receiver and a reinforced vaulting pole.

During a vaulting maneuver, a user may first insert the reinforced pole into the pole receiver. The height of the pole relative to the user may be adjusted using a bearing associated with the pole receiver. The bearing may also be movable relative to the housing such that the position of the pole receiver (and thus the reinforced pole) may also be shifted to the left or right of center according to the needs of the user (or as required during a vaulting maneuver). In positioning a pole in the pole receiver at least a portion of a reinforced portion of the pole may be positioned in the receiver.

Next, using a control panel, pressure control valves and flow control valves in the lift assembly may be set for the weight and speed rated for the user. Thereafter, when the user is ready, the apparatus may be activated such that a hydraulically drive arm in the lift assembly function to the pole receiver to pivot from an initial position to a predetermined second position. This predetermined second position may be at any point along the travel arc of pole receiver. Further, the rate of travel of the pole receiver (and thus the pole 18 and user) may be modified from a relatively slow rate to a relatively fast rate.

Finally, during a vaulting maneuver, a pair of sleeves in the pole receiver assists in stabilizing the pole in the pole receiver.

Further, since the pole may be free to rotate in the sleeves (and the pole receiver 14); the vaulting maneuver is not inhibited by the use of a static, fixed pole.

BRIEF DESCRIPTION OF THE DRAWINGS

Reference will now be made to the associated drawings, wherein like reference numerals refer to like parts throughout, and wherein.

DETAILED DESCRIPTION OF THE PREFERRED EMBODIMENTS

Figures 1, 2:
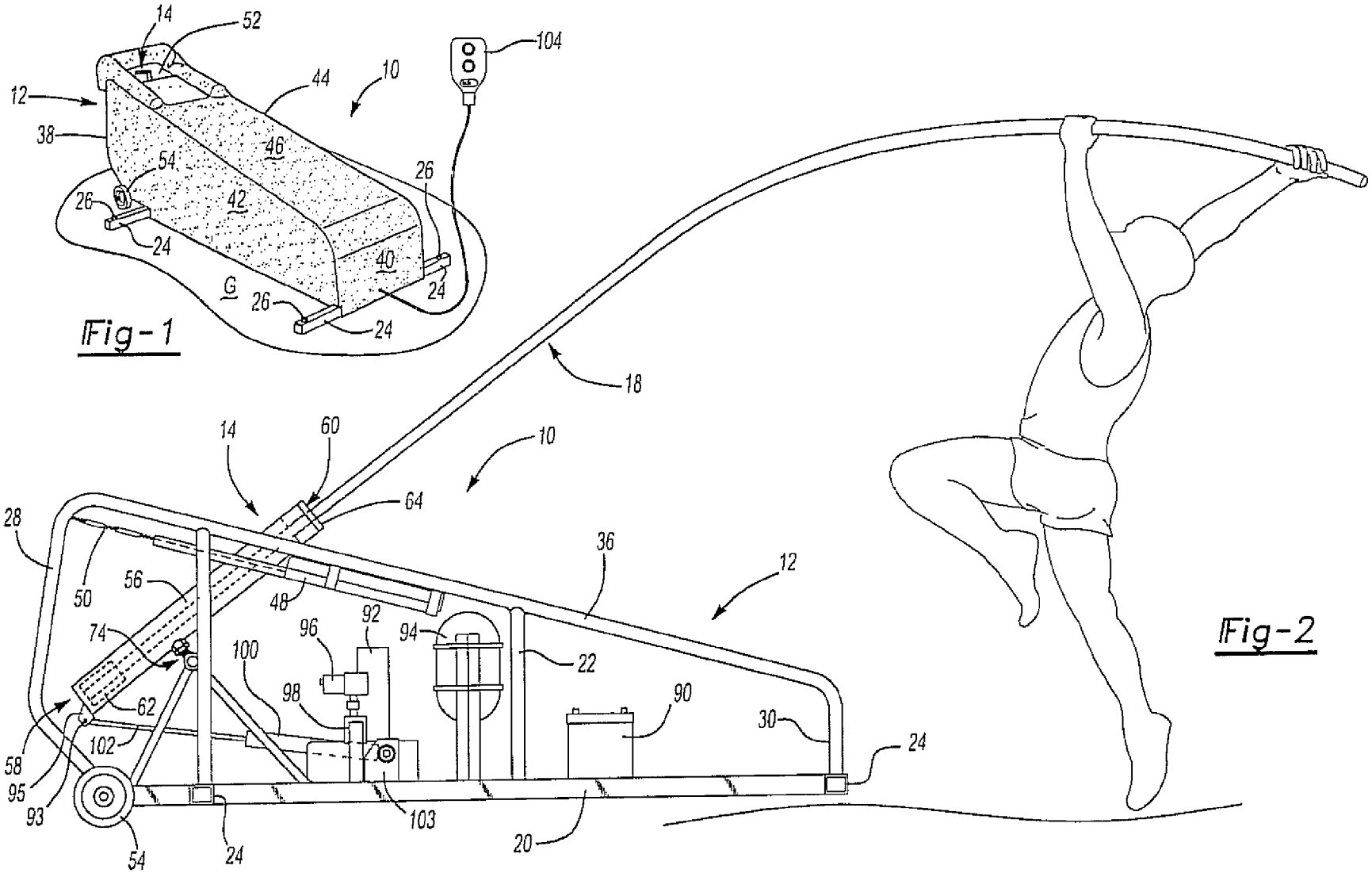
FIG. 1 is a perspective view of an embodiment of a pole vault training apparatus with a control unit for the apparatus extending from a housing of the apparatus.
FIG. 2 is a planar side view of the embodiment of a pole vault training apparatus shown in FIG. 1, with a sidewall of the housing removed and showing a vaulter near the beginning of a vaulting maneuver.

An embodiment of a pole vault training apparatus may include a housing or body, a pole receiver that may be pivotably positioned on the housing, a lift assembly that may be positioned in the housing and secured to the pole receiver and a reinforced vaulting pole. In operation, the vaulting pole may be placed in the pole receiver. The lift assembly may then be used to drive the pole receiver about the receiver's pivot point such that the pole may be raised or lowered through an arc of travel of about 50 degrees (i.e. from a position where the pole is at an orientation of about 45 degrees from horizontal to a position where the pole is at a vertical or past vertical orientation).

Referring now to FIGS. 1 through 10, one embodiment of a pole vault training apparatus 10 may include a housing 12 or body, a pole receiver 14 that may be pivotably positioned on the housing 12, a lift assembly 16 that may be positioned in the housing 12 and a reinforced vaulting pole 18 that may be placed in and supported by the pole receiver 14. The housing 12 may be adapted to be fixed to a floor or the ground "G" near a suitably padded pole vaulting "pit" (not shown). More specifically, the housing 12 may be positioned near or over a vault pole planting box (not shown) and next to a vaulting pit. The lift assembly 16 may operate to selectively actuate the pole receiver 14 such that the pole receiver 14, and any reinforced pole 18 position therein, may be lifted/pivoted from an initial orientation of about 45 degrees relative to the ground to an orientation of about 98 degrees (i.e., 8 degrees past vertical) relative to the ground, or to any point in between these limits.

Referring now to FIGS. 1 through 4, the housing 12 of the pole vault training apparatus 10 may include a base 20 that may rest on the ground "G" and a frame 22 that may be secured to the base 20. The frame 22 may also be constructed integral to the base 20. As best shown in FIGS. 1 and 2, the base 20 may be constructed in a rectangular form using square stock steel and angle iron. The base 20 may also include fixtures 24 or arms that extend outwardly from the base 20 to assist in stabilizing the base 20 (and thus the housing 12) on the ground "G". Mounting hardware 26 such as screws or stakes may be extended through or around the arms 24 to fix the pole vault training apparatus 10 to the ground "G".

Figures 4, 8, 9, 10:
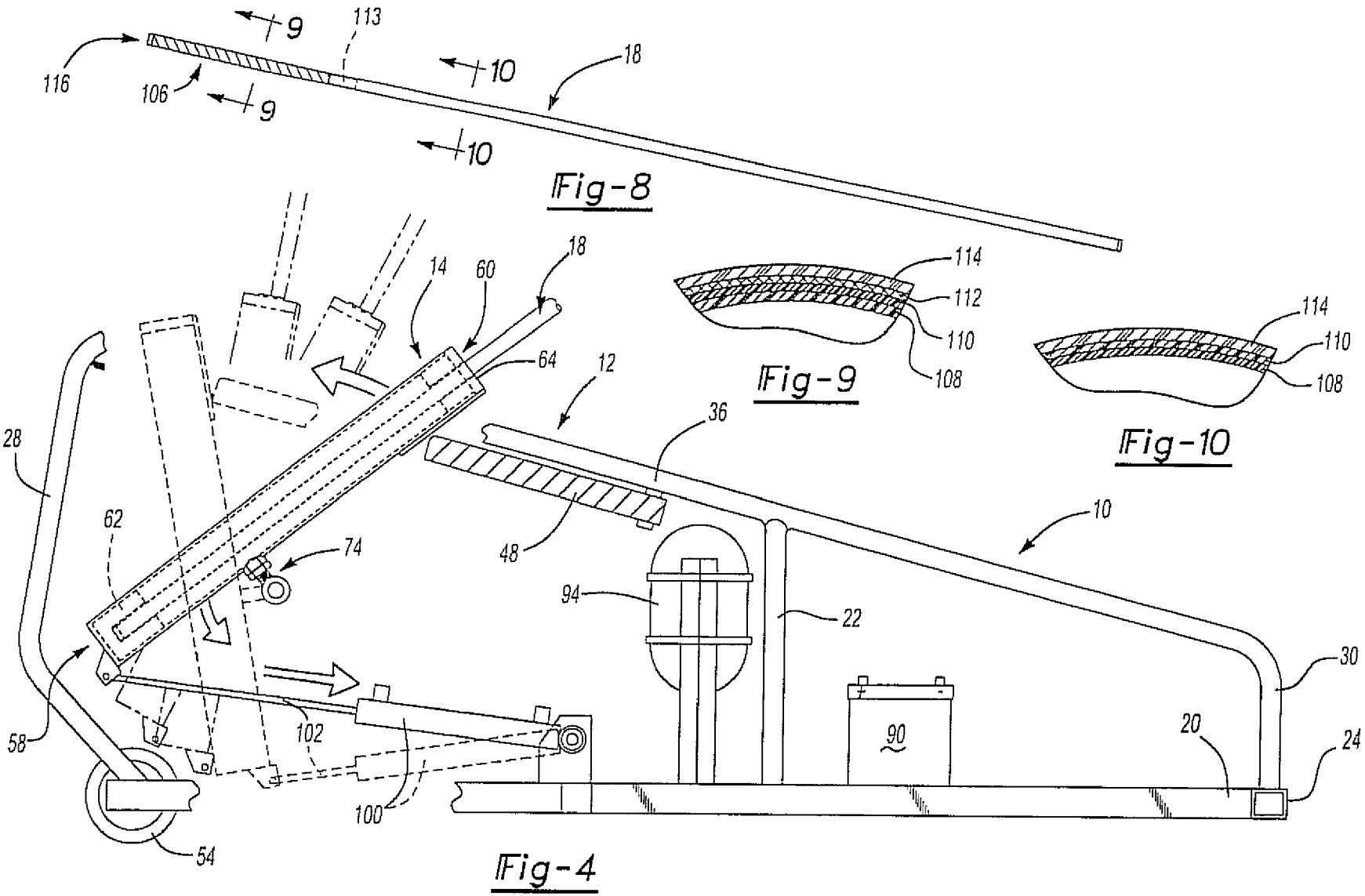
FIG. 4 is a partial planar side view of the embodiment of a pole vault training apparatus shown in FIG. 1 in which the pivoting movement of a pole receiver is detailed.
FIG. 8 is a perspective view of a reinforced pole vaulting pole.
FIG. 9 is a cutaway, partial side view of a wall of a reinforced pole vaulting pole taken along line 9-9 of FIG. 8.
FIG. 10 is a cutaway, partial side view of a wall of the reinforced pole vaulting pole taken along line 10-10 of FIG. 8.

Still referring to FIGS. 1 and 2, the frame 22 of the housing 12 may extend from the base 20 and define a front 28 and rear 30 ends of the housing 12 and a pair of sides and a top 36 for the housing 12. As shown, the frame 22 may be constructed using 1 inch tube steel. However, other materials having the requisite strength characteristics may also be used. As shown in FIG. 1, the ends 28, 30 sides and top 36 of the housing 12 may be substantially enclosed by, for example, sheet metal to create a front wall 38, a rear wall 40, a pair of side walls 42, 44 and a top wall 46. However, it will again be appreciated that other materials may also be used in the construction of the cover. As best shown in FIGS. 1 and 2, a door 48 biased by springs 50 that are secured to the front 28 of the frame 22 may be mounted for reciprocal movement to the top 36 of the housing 12 proximate the pole receiver 14. As shown in FIGS. 2 and 4, the door 48 may operate to move relative to the movement of the pole receiver 14 and thereby close off the opening 52 in the top 36 though which a portion of the pole receiver 14 may extend.

Still referring to FIGS. 1 and 2, one or more wheels 54 may also be positioned at the rear end 30 of the frame 22 proximate the base 20 to assist with the movement and/or placement of the pole vault training apparatus 10.

Referring now to FIGS. 1-4, the pole receiver 14 may include a tube or cylinder 56 having an open end 58 and a closed end 60. More specifically, in the embodiment disclosed herein, the pole receiver 14 may include a tube having a length of about 30 inches and an inside diameter of 4 inches. However, other dimension may also be used for the pole receiver 14. As mentioned above, the open end 58 of the pole receiver 14 may be positioned so that it extends though the top 38 of the housing 12.

Referring now to FIG. 1-5, a pair of support sleeves 62, 64 may be positioned within the pole receiver 14 to assist in retaining the reinforced pole 18 in the pole receiver 14. The sleeves 62, 64 may be constructed of nylon. However, other materials may also be used. One sleeve 62 may be positioned within the pole receiver 14 proximate the closed end 60. The outside diameter (or shape) of the sleeve 62 proximate the closed end 60 may be equal or close to the inside diameter (or shape) of the pole receiver 14. Further, the inside diameter of the sleeve 62 may be equal or close to the outside diameter of the reinforce pole 18. The other, second, sleeve 64 may be positioned proximate the open end 58 of the pole receiver 14 and may include a flange 66 at one end and an annular groove 68 along its length. The dimensions of the sleeve 64 positioned at the open end 58 of the pole receiver 14 may otherwise be similar to the dimensions of the first sleeve 62. As shown, the flange 64 may function to support the second sleeve 64 on the open end 58 of the pole receiver 14. Further, the groove 68 may be engaged by a locking screw 70 that may be extend though a threaded opening 72 in the pole receiver 14.

Figure 3:
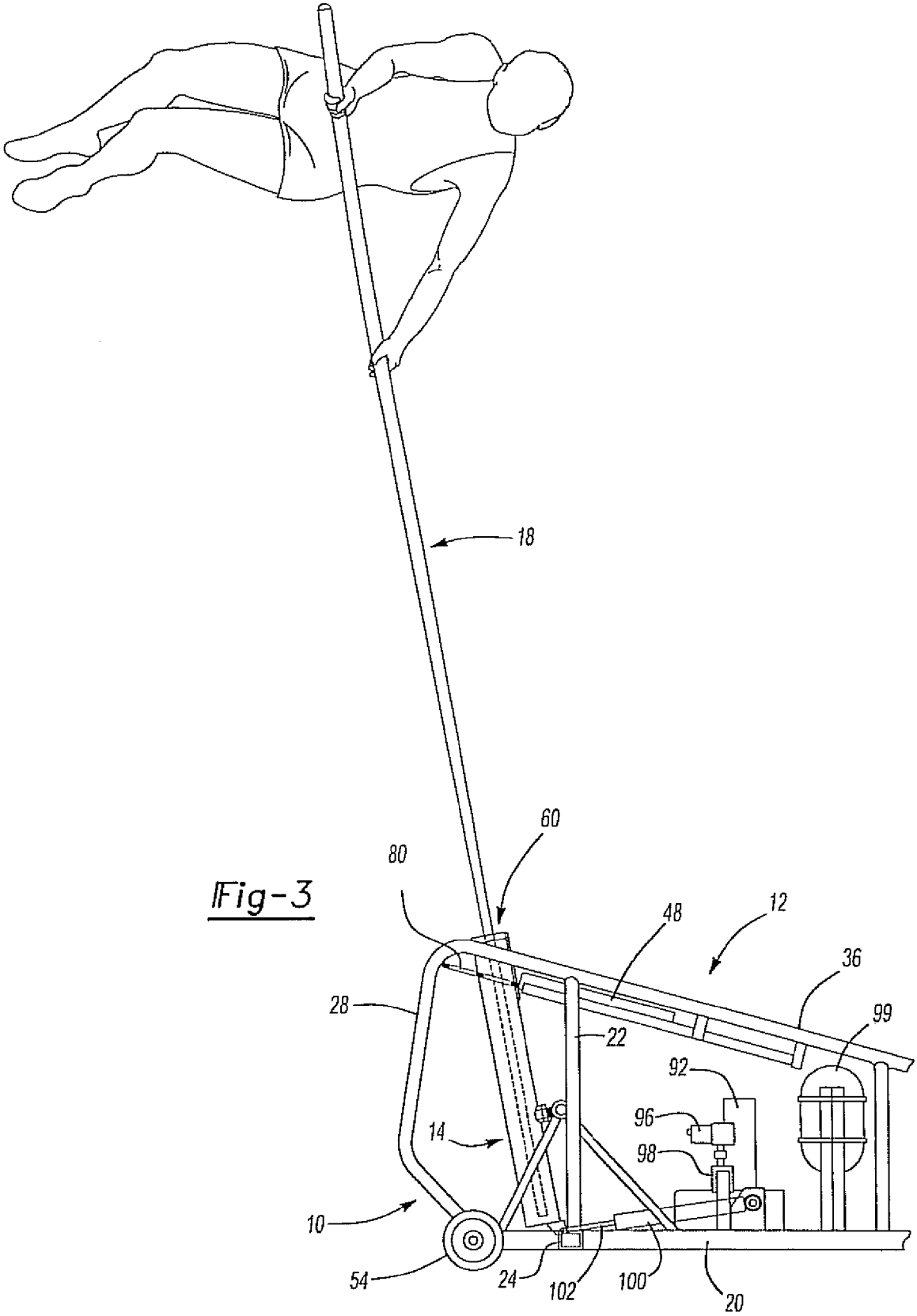
FIG. 3 is a partial planar side view of the embodiment of a pole vault training apparatus shown in FIG. 1, with a sidewall of the housing removed and showing a vaulter toward the end of a vaulting maneuver.
Figure 5:
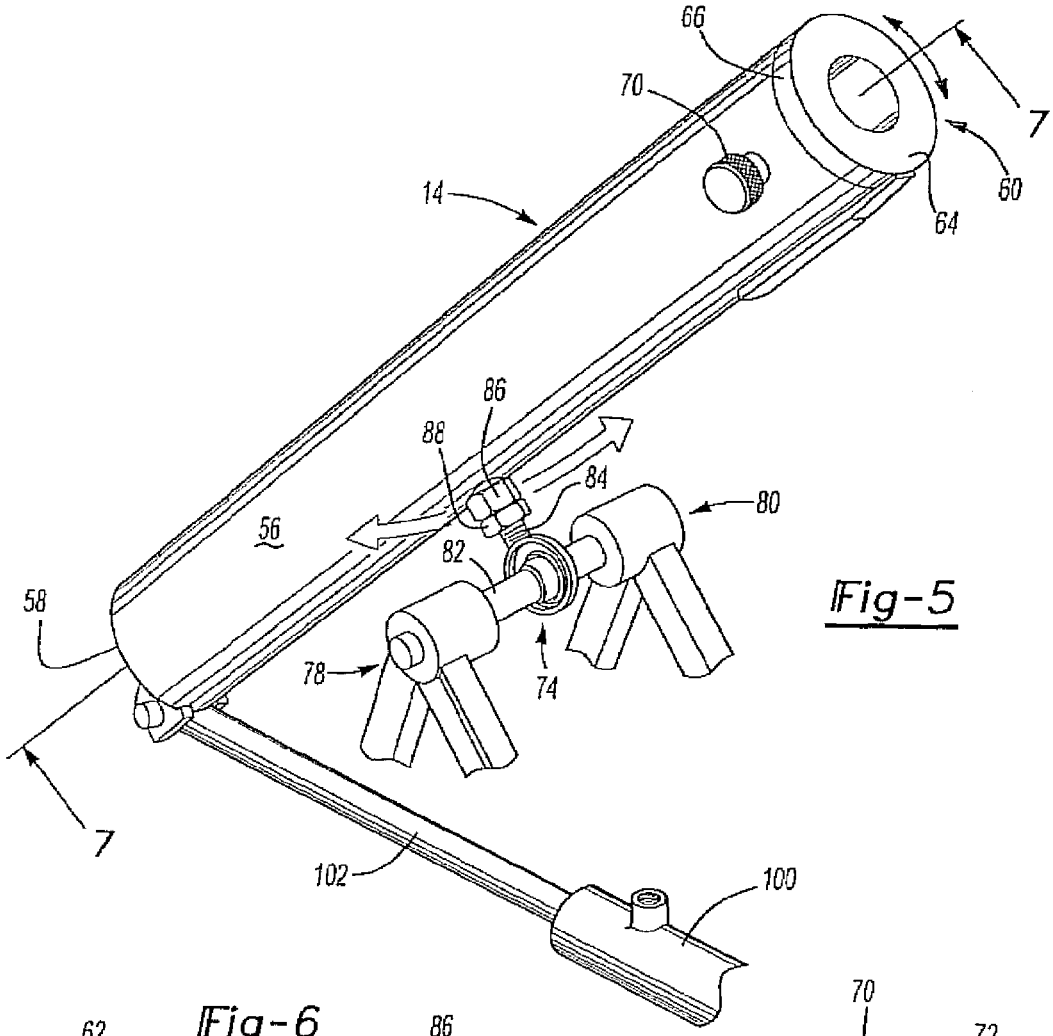
FIG. 5 is a perspective view of the pole receiver.
Figure 6:
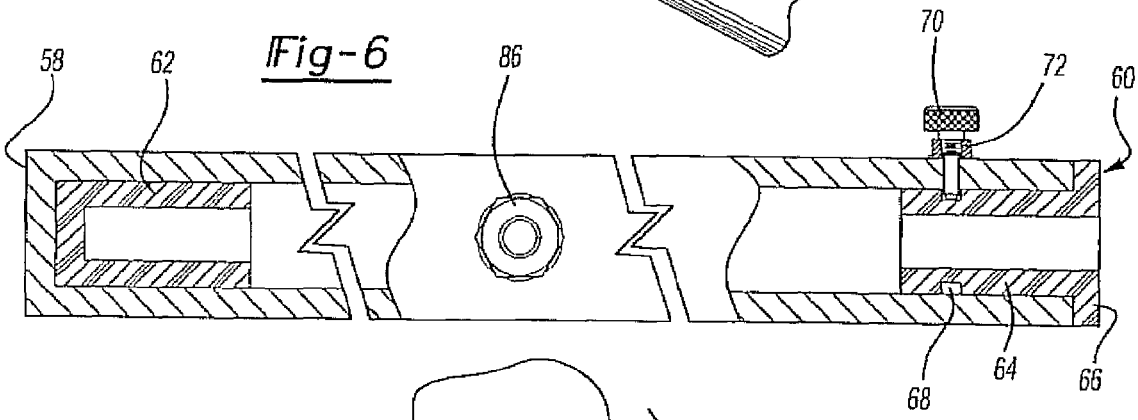
FIG. 6 is a cutaway side view of the pole receiver.
Figure 7:
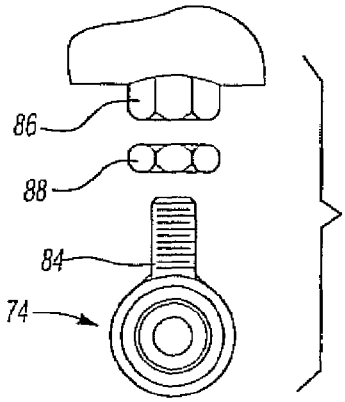
FIG. 7 is a planar side view of the support bearing for the pole receiver.

Still referring to FIGS. 1-7, the pole receiver 14 may be pivotably mounted on a bearing 74 that may be positioned on a support 76 that may be secured to the housing 12. Specifically, as best shown in FIG. 5, the support 76 includes two A-frames 78, 80 that are connected at their respective apexes by a crossbar 82. As best shown in FIGS. 2 and 3, each A-frame 78, 80 may be secured to the base 20 of the housing 12 at the ends opposite its respective apex. The bearing 74 may be moveably positioned on the crossbar 82 and may include a threaded rod 84. As best shown in FIG. 7, the threaded rod 84 of the bearing 74 may be used to engage a threaded opening 86 of the pole receiver 14. The threaded opening 86 of the pole receiver 14 may be located anywhere along the length of the receiver 14. However, it will be appreciated that a particularly advantageous location for the threaded opening 86 of the pole receiver may be proximate a midpoint of the receiver 14. As best shown in FIGS. 5 and 7, a nut 88 may be positioned on the threaded rod 84 as a means for locking the receiver 14 to the bearing. It will also be appreciated that the use of the threaded rod 84 and nut 88 will allow the position of the pole receiver 14 to be adjusted along the length of the rod 84. As will be described below, the adjustable nature of the receiver 14 relative to the bearing 74 may permit the starting height of the vaulting pole 18 to be customized to the height requirement of each individual user.

Referring now to FIG. 1-3 the lift assembly 16 may include a battery 90, a hydraulic pump 92, a fluid accumulator 94, a pressure control valve 96, a flow control valve 98 and a hydraulic cylinder 100 having a extendable arm 102. As best shown in FIG. 1, a control panel 104 may also be provided to actuate the lift assembly 16. It will be appreciated that while the lift assembly 16 of the particular embodiment disclosed herein may include a hydraulic system, other systems such as an electric or pneumatic drive may also be used. For example, the lift assembly may be configured using an electric drive that may be plugged into a standard electrical outlet.

Referring now to FIGS. 1-5, hydraulic cylinder 100 may be pivotably attached to a base bracket 103 at the end of the cylinder opposite the arm 102. Likewise, the arm 102 of the hydraulic cylinder 100 may be pivotably attached proximate the closed end 58 of the pole receiver 14. For example, the arm 102 may be pivotably secured to the pole receiver 14 by a pin 93 that engages a bracket 95 on the closed end 58 of the pole receiver 14. The arm 102 may be a 12 inch long extendable arm. However, it will be appreciated that an arm 102 having a greater or lesser length may also be used.

Still referring to FIGS. 1-3, in operation, the pump 92 operates to inflate a bladder (not shown) in the fluid accumulator 94 using a fluid (not shown) and thereby pressurize a hydraulic fluid (not shown) that may be stored in the accumulator 94. The pump 92 may be powered by the battery 90, which in the particular embodiment disclosed herein may be a 12 v battery. Further, the fluid used to inflate the bladder may be nitrogen. However, other fluids may also be used.

Still referring to FIGS. 1-3, the accumulator 94 may be in fluid communication with a normally closed solenoid controlled pressure control valve 96, which may be in fluid communication with a normally closed solenoid controlled flow control valve 98. During a vaulting maneuver, the pressure valve 96 may operate to regulate the pressure of the fluid. Likewise, the flow control valve 98 may operate to regulate the rate at which the fluid acts on the hydraulic cylinder 100. Accordingly, it will be appreciated that the duel valve 96, 98 arrangement of the lift assembly 16 may permit a user to customize the torque (or force of the lift) and the rate (or speed of the lift) for each user. For example, the pole vault training apparatus 10 may be controlled to lift a lightweight, novice user (e.g., an 8th grade male) at a relatively slow rate and then quickly modified to lift a heavyweight, expert user (e.g., a NCAA athlete) at a relatively rapid rate. In operation, at a predetermined time (e.g., when activated by a user using the control panel 104) the pressure control valve 96 and flow control valve 98 may each be opened a predetermined amount and in a predetermined sequence (again, as may be dictated by the control panel 104) to cause the hydraulic fluid to flow from the accumulator 94 through valves 96, 98 and to the hydraulic cylinder 100.

Referring now to FIGS. 8 through 10, the reinforced pole 18 of the pole vault training apparatus 10 may include a fiberglass pole that has one or more layers of reinforcing material 106. The means of constructing the reinforced pole 18 may not be substantially different from the current technology for constructing fiberglass poles. However, unlike current poles, the reinforced pole 18 may include one or more layers of a reinforcing material such as carbon fiber, KEVLAR or further layers of fiberglass. For example, as shown in FIG. 9, the reinforced pole may include a layer of fiberglass 108, one or more layers of a reinforcing material 110, 112 and then a layer of resin 114. In addition, or as an alternative to the reinforcing material 110, 112, a tubular insert 113 may be positioned within the pole 18 proximate a location where the pole 18 would engage the sleeve 64 (or the open end 60 of the pole receiver 14) during a vaulting maneuver as a precaution against a collapse of the pole 18. For example, 6 inch tubular or cylindrical insert may be inserted or otherwise positioned within the pole 18 such that approximately one half of the insert would with be positioned within the pole receiver 16 and one half of the insert would be positioned external to the pole receiver 16. The insert 113 may be constructed of nylons However, steel, carbon fiber or KEVLAR may also be used in the construction of the insert 113. Further, the insert 113 may have a length that is greater or lesser than 6 inches For example, as shown in the illustrated embodiment, the insert 113 may be longer than 6 inches such that it might extend beyond the layers or wraps of reinforcing material 106.

Still referring to FIGS. 8 through 10, the reinforcing material 106 may be positioned at any location along the length of the pole 18. However, as best shown in FIG. 8, the reinforcing material 106 may be provided at end 116 of the pole 18 that is intended to be inserted into the pole receiver 14. More particularly the reinforcing material 106 may be provided at one end 116 of the pole and along the pole for a length of between about 24 and 48 inches, and in many instances about 36 inches from the end 116 of the pole 18. As such it will be appreciated that the reinforcing material may be provided on between 11% to 38% of the length of a pole (depending on the length of the pole). As best shown in FIG. 10, the pole 18 may be tapered above the reinforced portion to match the construction of a standard non-einforced vaulting pole.

Referring now to FIG. 1-4, as mentioned above during a vaulting maneuver, a user will first insert the reinforced pole 18 into the pole receiver 14. As mentioned above, the height of the pole 18 relative to the user may be adjusted using the bearing 74. Further, since the bearing 74 may be movable along the crossbar 82, the position of the pole receiver 14 (and thus the reinforced pole 18) may also be shifted to the lift or right of center according to the needs of the user (or as required during a vaulting maneuver). In positioning the pole 18 in the pole receiver 14 at least a portion of the reinforced area 106 of the reinforced pole 18 may be positioned in the receiver 18. Next, using the control 104, the pressure valve 96 and flow control 98 valves may be set for the weight and speed rated for the user. For example, it takes approximately 1600 psi to lift a 120 lbs vaulter 13 feet from the standing position (i.e. the position where the receiver as at its lowest point). Thereafter, when the user is ready, the apparatus 10 may be activated such that the lift assembly 16 may cause the pole receiver 14 to pivot about the support 76 from an initial position to a predetermined second position. This predetermined second position may be at any point along the travel arc of pole receiver 14. Further, as mentioned above, the rate of travel of the pole receiver 14 (and thus the pole 18 and user) may be modified from a relatively slow rate to a relatively fast rate. During a vaulting maneuver, the sleeves 62, 64 of the pole receiver 14 assist in stabilizing the pole 18 in the pole receiver 14. Further, since the pole 18 may be free to rotate in the sleeves 62, 64 (and the pole receiver 14), the vaulting maneuver is not inhibited by the use of a static, fixed pole.

Having thus described an embodiment of the invention, various other embodiments that do not depart from the scope of the claims set forth below will become apparent to those of skill in the art.

The invention claimed is:

1. A pole vault training apparatus comprising;

a housing;

a receiver for a vaulting pole, the receive being pivotably positioned on the housing;

a lift assembly positioned in the housing having at least one of an electrically, pneumatically, or hydraulically driven member engaging the receiver, the assembly operating to drive the receiver from a first position to a second pivotably distinct position;

whereby the apparatus is operable to permit a user to insert the vaulting pole into the receiver and perform a vault maneuver starting from a position near the apparatus.

2. The pole vault training apparatus of claim 1, wherein the housing comprises a base and a frame mounted to the base.

3. The pole vault training apparatus of claim 1 wherein the receiver comprises an elongated tube.

4. The pole vault train apparatus of claim 3, wherein the receiver further comprises a first and a second sleeve positioned proximate opposite ends of the elongated tube.

5. The pole vault training apparatus of claim 1, wherein the lift assembly comprises a pressure control valve and a flow control valve.

6. The pole vault training apparatus of claim 1, further comprising a reinforced vaulting pole.

7. The pole vault training apparatus of claim 6, wherein the reinforced vaulting pole comprises a reinforcing material.

8. The pole vault training apparatus of claim 7, wherein the reinforcing material is selected from a group consisting of fiberglass, KEVLAR and carbon fiber.

9. The pole vault training apparatus of claim 7, wherein the reinforcing material is applied to between 11 to 38 percent of the length of the pole.

10. The pole vault training apparatus of claim 7, wherein the reinforcing material is applied along the length of the pole for about 36 inches from one end of the pole.

11. A pole vault training apparatus comprising:

a base;

a receiver for a vaulting pole, the receiver being pivotably positioned to the base;

a power actuated arm, one end of die arm being positioned on the base and an opposite end of the arm being secured to the receiver;

a reinforced vaulting pole operable to be received in the receiver; and whereby the apparatus is operable to permit a user to perform a vault maneuver starting from a position near the apparatus.

12. The pole vault training apparatus of claim 11, where the lift assembly comprises a pressure control valve and a flow control valve.

13. The pole vault training apparatus of claim 11, wherein the reinforced vaulting pole comprises at least two reinforcing materials.

14. The pole vault training apparatus of claim 11, wherein the reinforced vaulting pole comprises a reinforcing material that is applied to between 11 to 38 percent of the length of the pole.

15. The pole vault training apparatus of claim 11, wherein the reinforced vaulting pole comprises a reinforcing material that is applied along the length of the pole for about 36 inches from one end of the pole.

16. The pole vault training apparatus of claim 11, wherein the reinforced vaulting pole comprises an anti-collapse insert.

17. A pole vault training apparatus comprising:

a base;

a pole receiver pivotably mounted on the base;

a lift assembly positioned on the base and operable to actuate the pole receiver such that the pole receiver travels from a first position to a second position;

a lift assembly control operable to control the operation of the lift assembly;

a vaulting pole operable to be received in the pole receiver;

a reinforcement apparatus positioned on the vaulting pole; and whereby the apparatus is operable to permit a user to perform a vault maneuver starting from a position near the apparatus.

18. The pole vault training apparatus of claim 17, wherein the pole receiver further comprises a height adjustable bearing.

19. The pole vault training apparatus of claim 17, wherein the pole receiver further comprises a bearing moveably mounted on the base.

20. The pole vault training apparatus of claim 17, wherein the reinforcement apparatus comprises an anti-collapse insert.

* * * * *

UNITED STATES PATENT AND TRADEMARK OFFICE

CERTIFICATE OF CORRECTION

PATENT NO. : 7,585,253 B2
APPLICATION NO. : 11/624060
DATED : September 8, 2009
INVENTOR(S) : Kirk Richards It is certified that error appears in the above-identified patent and that said Letters Patent is hereby corrected as shown below:

Column 3, Line 43 - delete "FIG." and insert --FIGS.--
Column 4, Line 22 - delete "FIG." and insert --FIGS.--
Column 5, Line 28 - delete "nylons" and insert --nylon--
Column 5, Line 48 - delete "non-einforced" and insert --non-enforced--
Column 5, Line 49 - delete "FIG." and insert --FIGS.--
Column 6, Line 57 - delete "die" and insert --the--

Signed and Sealed this

Twenty-second Day of December, 2009

David J. Kappos

David J. Kappos
*Director of the United States Patent and Trademark Office*